US012648649B2

(12) United States Patent
Deng

(10) Patent No.: US 12,648,649 B2
(45) Date of Patent: Jun. 9, 2026

(54) CHAIRBACK STRUCTURE CAPABLE OF PROVIDING DYNAMIC SUPPORT FOR USERS IN DIFFERENT SITTING POSTURES

(71) Applicant: NEWTRAL FURNITURE TECHNOLOGY INC., Shenzhen (CN)

(72) Inventor: Jianbo Deng, Shenzhen (CN)

(73) Assignee: NEWTRAL FURNITURE TECHNOLOGY INC., Shenzhen (CN)

( * ) Notice: Subject to any disclaimer, the term of this patent is extended or adjusted under 35 U.S.C. 154(b) by 153 days.

(21) Appl. No.: 18/782,975

(22) Filed: Jul. 24, 2024

(65) Prior Publication Data

US 2026/0013637 A1 Jan. 15, 2026

Related U.S. Application Data

(63) Continuation of application No. PCT/CN2024/105444, filed on Jul. 15, 2024.

(30) Foreign Application Priority Data

Jul. 11, 2024 (CN) ..... 202421640266.8

(51) Int. Cl.
*A47C 7/46* (2006.01)
*A47C 7/44* (2006.01)

(52) U.S. Cl.
CPC ..... *A47C 7/462* (2013.01); *A47C 7/443* (2013.01)

(58) Field of Classification Search
CPC ..... A47C 7/46; A47C 7/443; B60N 2/66
See application file for complete search history.

(56) References Cited

U.S. PATENT DOCUMENTS 4,097,087 A * 6/1978 Garavaglia ..... A47C 7/46 297/284.7
5,112,106 A * 5/1992 Asbjornsen ..... A47C 7/46 297/284.7

(Continued)

FOREIGN PATENT DOCUMENTS

CN 202161000 U 3/2012
CN 216220857 U 4/2022

(Continued)

OTHER PUBLICATIONS

International Search Report issued in corresponding International application No. PCT/CN2024/105444, mailed Mar. 20, 2025.

(Continued)

*Primary Examiner* — Joshua J Michener
*Assistant Examiner* — Nevena Aleksic
(74) *Attorney, Agent, or Firm* — HOWARD M COHN and Associates, LLC

(57) ABSTRACT

The invention provides a chairback structure capable of providing dynamic support for users in different sitting postures. A horizontal movement mechanism and an elastic lifting mechanism are arranged to control horizontal and vertical movements of a second chairback, and the second chairback can move both horizontally and vertically. Under the action of elastic forces provided by springs, the horizontal movement mechanism and the elastic lifting mechanism can drive the second chairback to move with the movement of the waist of users, and the second chairback can closely fit and support the waist of the users no matter which posture the users are in, thus realizing dynamic support, bringing comfortable usage experience to the users, and relieving fatigue and pains of the waist of the users caused by long-term sitting.

4 Claims, 9 Drawing Sheets

(56) References Cited

U.S. PATENT DOCUMENTS

| | | | | |
|---|---|---|---|---|
| 6,945,601 | B1 * | 9/2005 | Wu | A47C 7/40 297/410 |
| 6,981,743 | B2 * | 1/2006 | Edwards | A47C 7/402 297/284.7 |
| 7,303,232 | B1 * | 12/2007 | Chen | A47C 7/38 297/284.7 |
| 2012/0193959 | A1 * | 8/2012 | Chen | A47C 7/38 297/301.1 |
| 2012/0242130 | A1 * | 9/2012 | Hung | A47C 7/46 297/344.18 |
| 2019/0281988 | A1 * | 9/2019 | Su | A47C 7/46 |
| 2023/0081447 | A1 * | 3/2023 | Deng | A47C 7/462 297/301.4 |

FOREIGN PATENT DOCUMENTS

| | | | |
|---|---|---|---|
| CN | 219438625 | U | 8/2023 |
| CN | 219578572 | U | 8/2023 |
| CN | 219629153 | U | 9/2023 |
| KR | 20090002656 | U | 3/2009 |

OTHER PUBLICATIONS

Written Opinion of the International Search Authority in corresponding International application No. PCT/CN2024/105444, mailed Mar. 20, 2025.

* cited by examiner

CHAIRBACK STRUCTURE CAPABLE OF PROVIDING DYNAMIC SUPPORT FOR USERS IN DIFFERENT SITTING POSTURES

BACKGROUND OF THE INVENTION

1. Technical Field

The invention relates to the technical field of chairs, and particularly relates to a chairback structure capable of providing dynamic support for users in different sitting postures.

2. Description of Related Art

With the rapid development of economy, people are under high pressure at work, and office staff often must sit at their desk for a long time, which inevitably leads to a series of ailments. The long-term lack of support and stretching of the waist will cause lumbar disc herniation and poor blood circulation, leading to great harm. Therefore, it is necessary to design a suitable structure for the waist to relieve the pressure to the waist.

At present, a waist cushion, the height and back-leaning angle of which can be slightly adjusted, is mounted on the chairback of most chairs on the market, and the waist can be supported to some extent by the waist cushion. However, the waist cushion has only one function, users have to keep themselves in a fixed sitting posture and position to have their waist to be supported by the waist cushion, the waist cushion can move only within a certain angle range, and once the users deviate from this angle range, their waist will not be supported by the waist cushion anymore. Therefore, the support effect and comfort of the waist cushion need to be improved.

BRIEF SUMMARY OF THE INVENTION

In view of the defect that the waist cushion cannot move along with the waist and thus cannot provide good comfort in the prior art, the invention provides a chairback structure capable of providing dynamic support for users in different sitting postures.

To fulfill the above purpose, the invention provides a chairback structure capable of providing dynamic support for users in different sitting postures, comprising:

a first chairback;

a chairback support, the chairback support having an end fixedly connected to the first chairback and an end movably connected to a seat; and a horizontal movement mechanism, the horizontal movement mechanism having an end sleeved with the chairback support and an end provided with an elastic lifting mechanism, the elastic lifting mechanism having an end fixedly connected to the horizontal movement mechanism and an end provided with a second chairback, and the second chairback being movably connected to the elastic lifting mechanism;

the second chairback being able to move forward and backward as well as upward and downward by means of the horizontal movement mechanism and the elastic lifting mechanism.

As an improved scheme of the invention, the horizontal movement mechanism comprises a sliding tube with an open end, a first spring and an adjusting knob, a fixing tube with two open ends is arranged on the chairback support, and the chairback support is disposed around the fixing tube; the adjusting knob is movably connected to an end of the fixing tube; a positioning pillar is arranged on an end surface of the adjusting knob and sequentially sleeved with the first spring, the sliding tube and the fixing tube; the sliding tube is in sliding fit with the fixing tube, and an end, close to the elastic lifting mechanism, of the sliding tube is fixedly connected to the elastic lifting mechanism; and the first spring has an end fixed to the end surface of the adjusting knob and an end abutting against an inner end surface of the sliding tube.

As an improved scheme of the invention, the elastic lifting mechanism comprises a sliding support, a slider and at least one second spring, a recess is formed in the second chairback, and the sliding support is fixedly arranged in the first recess; the slider is disposed around the sliding support, at least two first sliding grooves are formed in one side, close to the second chairback, of the sliding support, the second springs are arranged in the first sliding grooves, the slider is provided with at least two bumps, and each of the bumps correspondingly stretches into at least one of the first sliding grooves and correspondingly abuts against one second springs; and a connecting block is arranged on the other side of the sliding support, a threaded connecting hole is formed in the connecting block, a mounting hole is formed in an end, away from the adjusting knob, of the sliding tube, the connecting block is disposed in the mounting hole, a connecting hole is formed in a wall of the sliding tube, and an external bolt penetrates through the connecting hole and the threaded connecting hole to realize stationary fit between the sliding support and the sliding tube.

As an improved scheme of the invention, at least one limiting groove is formed in a side of the slider, a first slot is formed in a wall, opposite to the limiting groove, of the first recess, a limiting and adjusting rod and a fixing part are arranged on the second chairback, the fixing part is fixedly arranged in the first slot, the limiting and adjusting rod is disposed in a cavity of the fixing part and movably connected to the fixing part, and an end of the limiting and adjusting rod is inlaid in the limiting groove by means of the first slot.

As an improved scheme of the invention, at least one limiting through-hole is formed in a wall of the sliding tube, a first connecting tube with an open end is formed on an outer wall of a fixing tube, the open end of the first connecting tube is sleeved with a limiting knob, the limiting knob is movably connected to the first connecting tube, a first through-hole is formed in a wall, connected to the sliding tube, of the first connecting tube, the limiting knob is fixedly connected to one end of a limiting pillar, and the other end of the limiting pillar is inlaid in the limiting through-hole by means of the first through-hole.

As an improved scheme of the invention, at least one sliding wheel is symmetrically arranged on an outer wall of the sliding tube and fixedly connected to the sliding tube; at least one guide pillar is arranged on an inner wall of the fixing tube and integrally formed with the fixing tube, guide grooves are formed in the guide pillars, sides, provided with the guide grooves, of two guide pillars face each other, and the at least one sliding wheel is inlaid between the two guide grooves.

As an improved scheme of the invention, a first connecting pillar with two open ends is arranged in the first connecting tube, two opposite external threads are symmetrically arranged on an outer wall of the first connecting pillar, a second connecting tube with an open end is arranged on an end surface, connected to the limiting pillar, of the limiting knob, at least two second connecting pillars are symmetrically arranged on an inner wall of the second connecting tube, and the two second connecting pillars clamp the first connecting pillar and fit the external threads.

Compared with the prior art, the chairback structure capable of providing dynamic support for users in different sitting postures provided by the invention has the following beneficial effects: the horizontal movement mechanism and the elastic lifting mechanism are arranged to control horizontal and vertical movements of the second chairback, and the second chairback can move both horizontally and vertically; under the action of elastic forces provided by the springs, the horizontal movement mechanism and the elastic lifting mechanism can drive the second chairback to move with the movement of the waist of users, and the second chairback can closely fit and support the waist of the users no matter which posture the users are in, and can dynamically support the waist of the users when the waist of the users moves; and the chairback structure has an extremely high degree of freedom, brings comfortable usage experience to the users, and relieves fatigue and pains of the waist of the users caused by long-term sitting.

MAIN REFERENCE SIGNS

1, first chairback; 2, second chairback; 21, first recess; 3, chairback support; 31, fixing tube; 311, guide pillar; 312, guide groove; 4, horizontal movement mechanism; 41, sliding tube; 411, limiting through-hole; 42, first spring; 43, adjusting knob; 44, positioning pillar; 45, sliding wheel; 5, elastic lifting mechanism; 51, sliding support; 511, first sliding groove; 512, connecting block; 52, slider; 521, bump; 522, limiting groove; 53, second spring; 6, first connecting tube; 61, first connecting pillar; 611, external thread; 612, clamping groove; 7, limiting knob; 71, limiting pillar; 72, second connecting tube; 73, second connecting pillar; 8, connecting hole; 9, threaded connecting hole.

DETAILED DESCRIPTION OF THE INVENTION

To better clarify the invention, the invention is further described below in conjunction with the accompanying drawings.

Details of the embodiments are provided in the following description to gain a deeper understanding of the invention. Obviously, the embodiments in the following description are merely illustrative ones, and are not all possible ones of the invention. It should be understood that the specific embodiments described below are used for explaining the invention and are not intended to limit the invention.

It should be understood that terms "include" and/or "comprise" used in the description indicate the presence of features, entities, steps, operations, elements or modules referred to and do not exclude the presence or addition of one or more other features, entities, steps, operations, elements, modules or combinations thereof.

Figure 1:
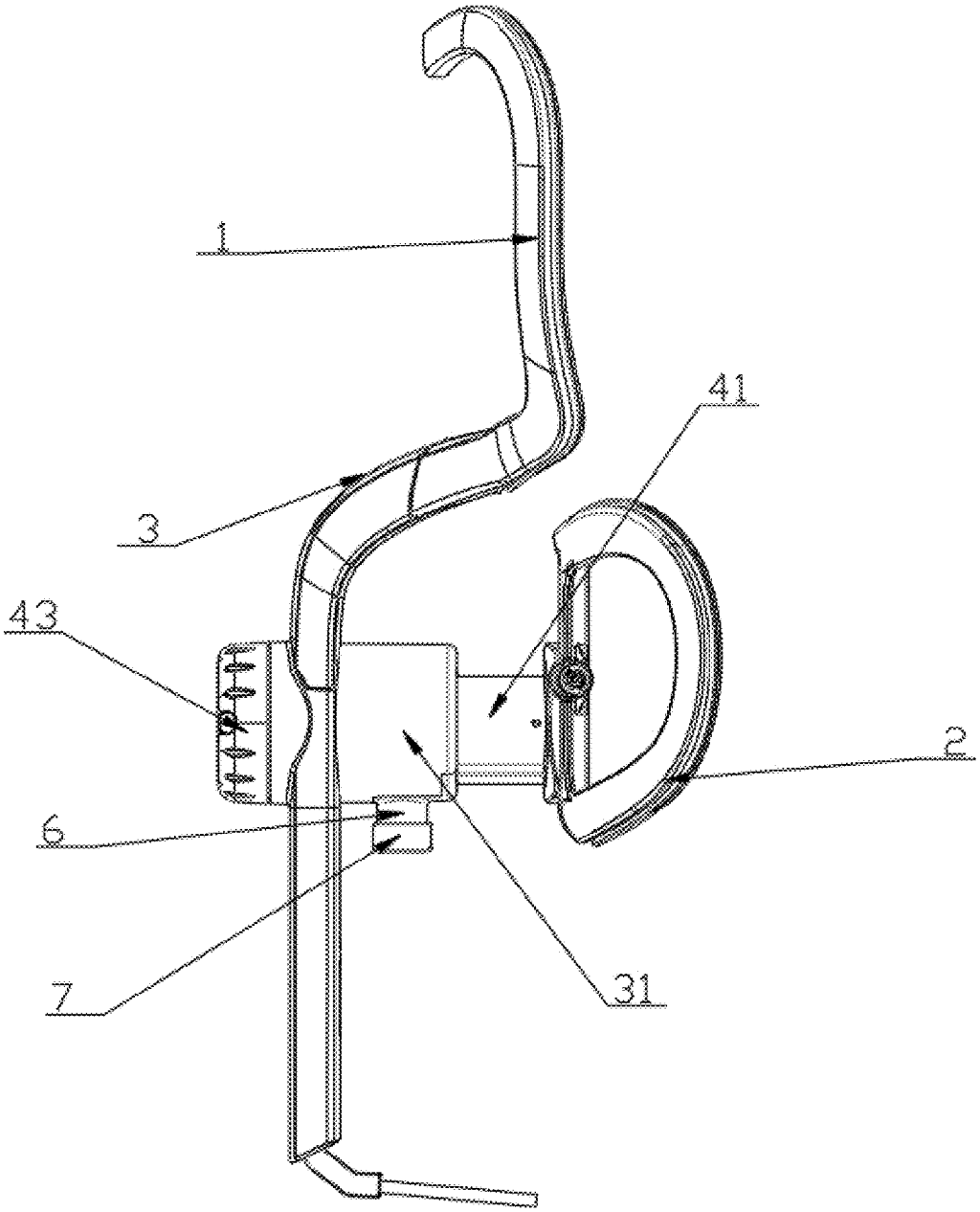
FIG. 1 is a left view of the invention.
Figure 2:
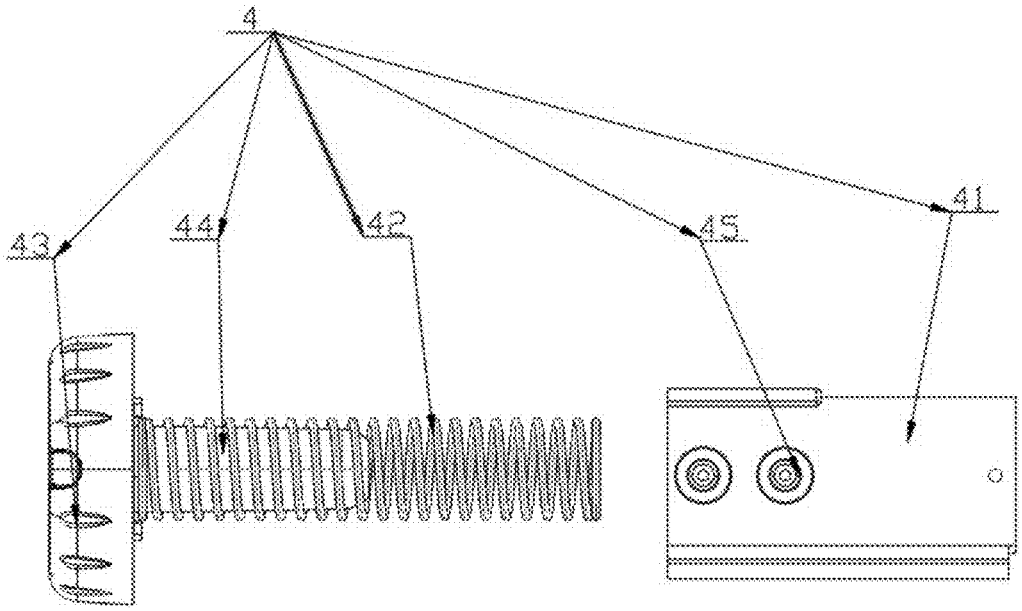
FIG. 2 is an exploded view of a horizontal movement mechanism according to the invention.
Figure 3:
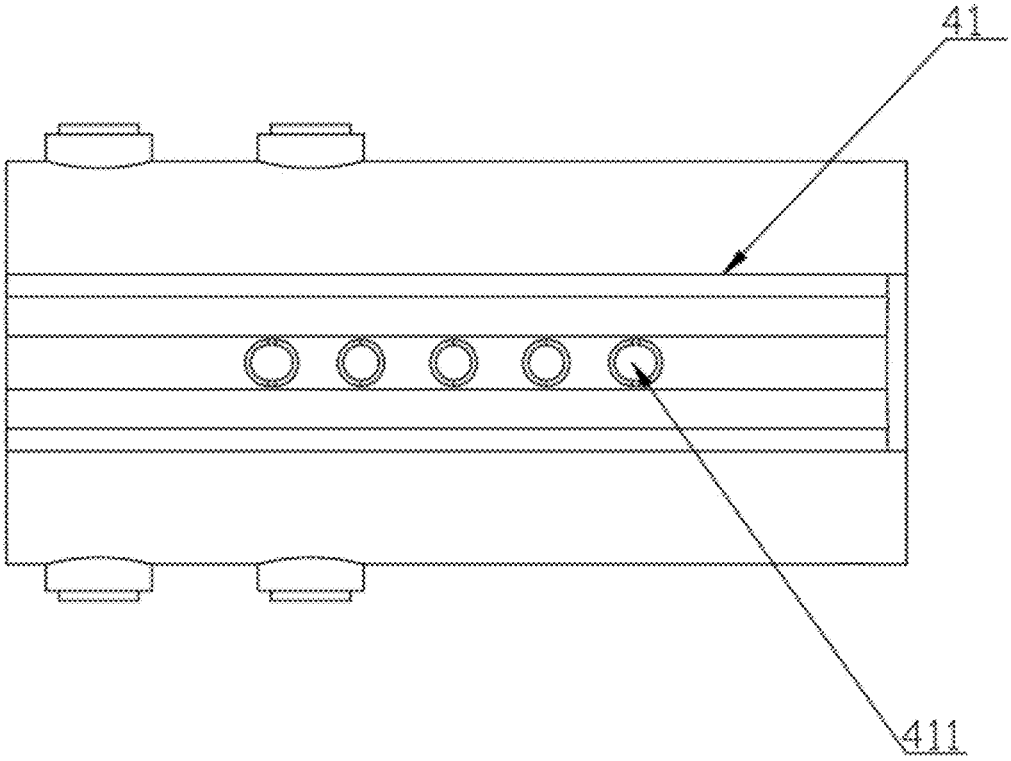
FIG. 3 is a bottom view of a sliding tube according to the invention.
Figure 4:
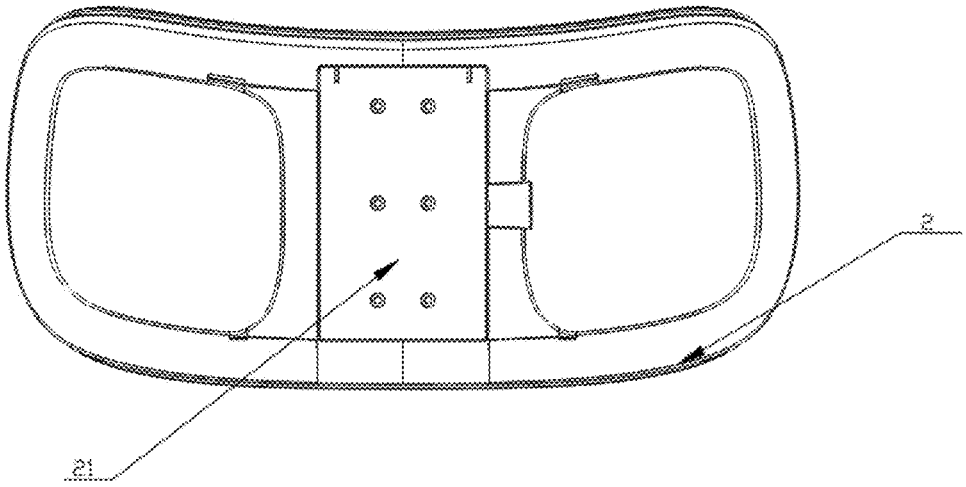
FIG. 4 is a schematic diagram of a first recess according to the invention.
Figure 5:
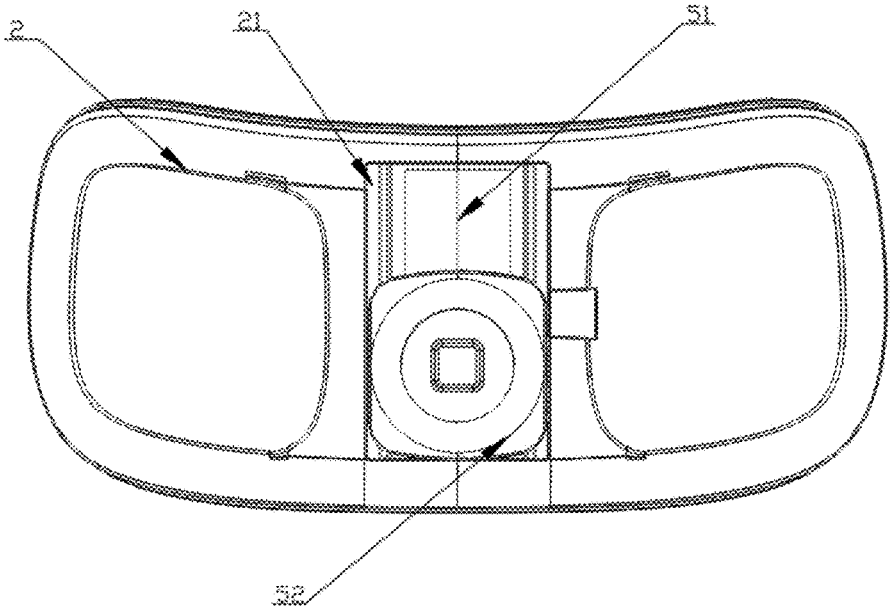
FIG. 5 is a back view of a second chairback according to the invention.
Figure 6:
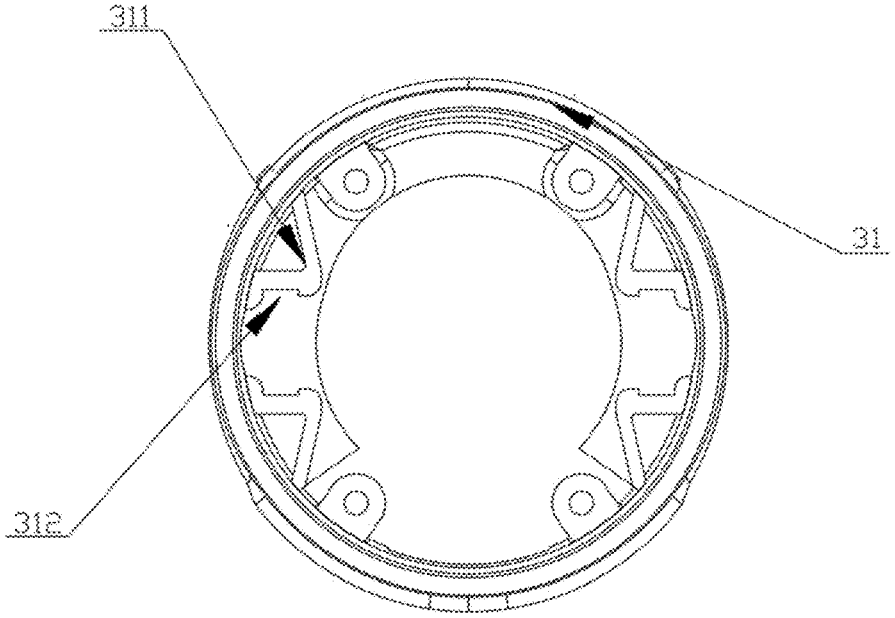
FIG. 6 is a schematic diagram of a fixing tube according to the invention.
Figure 7:
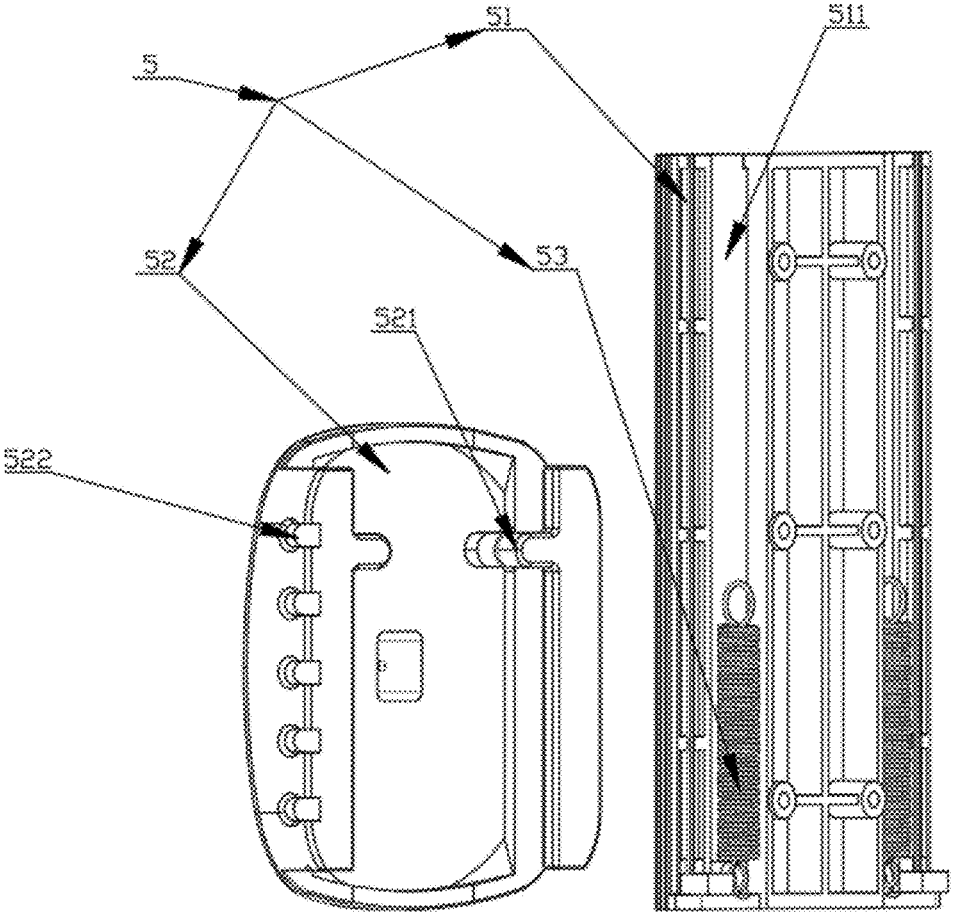
FIG. 7 is an exploded view of an elastic lifting mechanism according to the invention.
Figure 8:
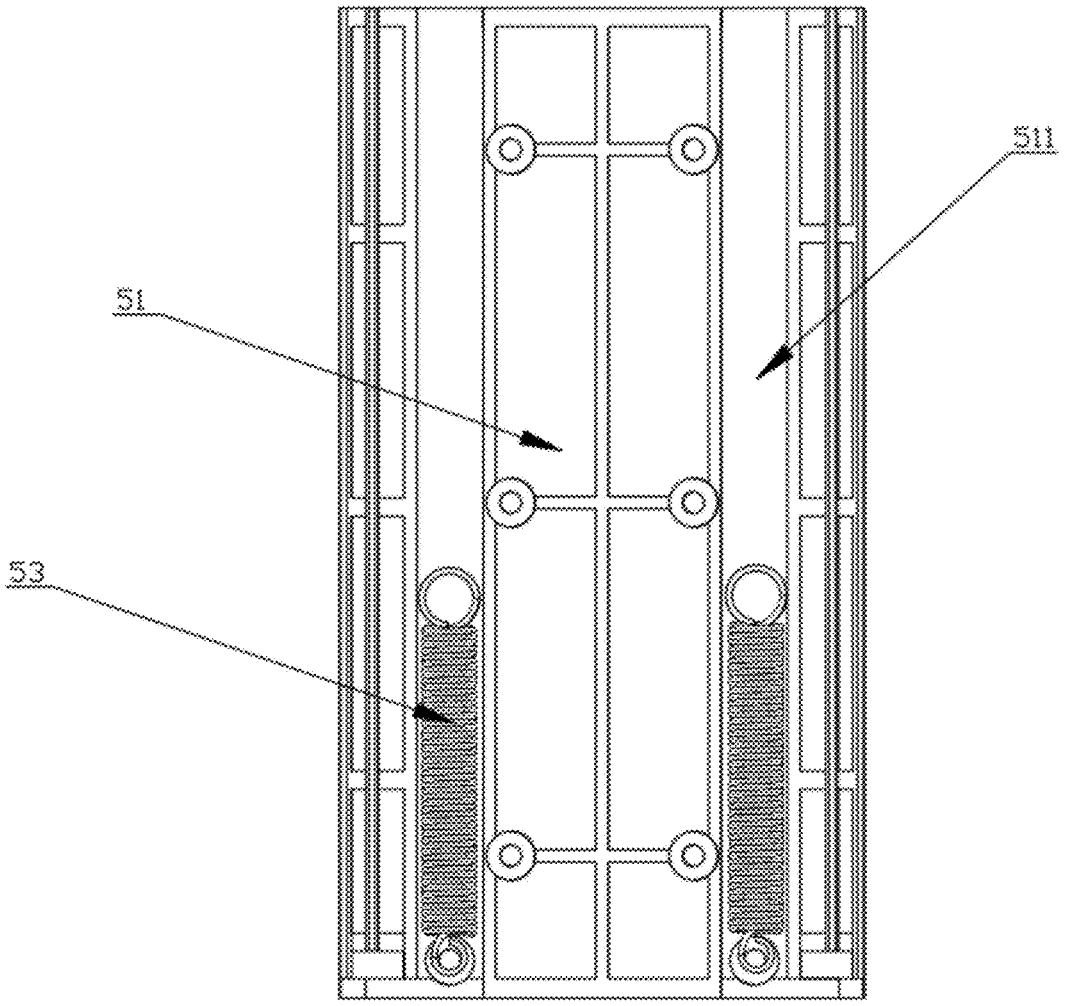
FIG. 8 is a schematic diagram of a sliding support according to the invention.
Figure 9:
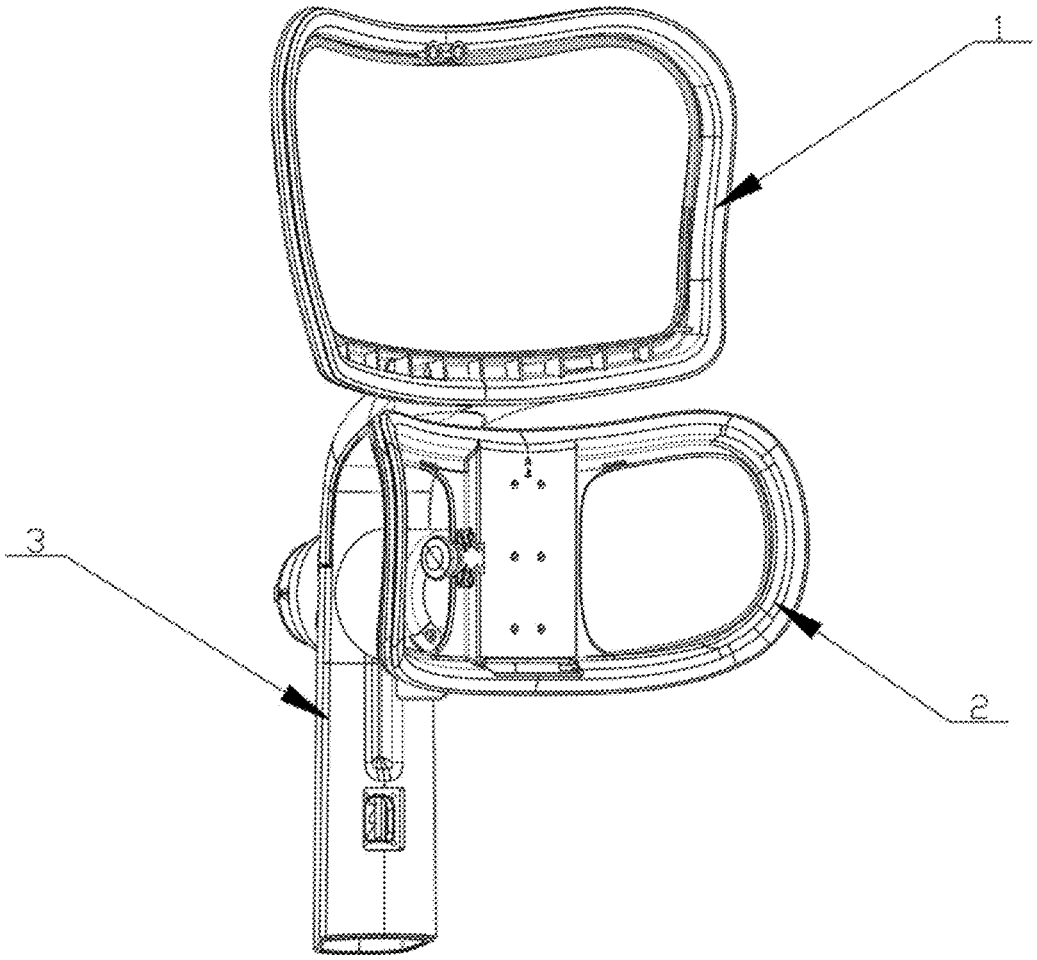
FIG. 9 is a perspective view of the invention.
Figure 10:
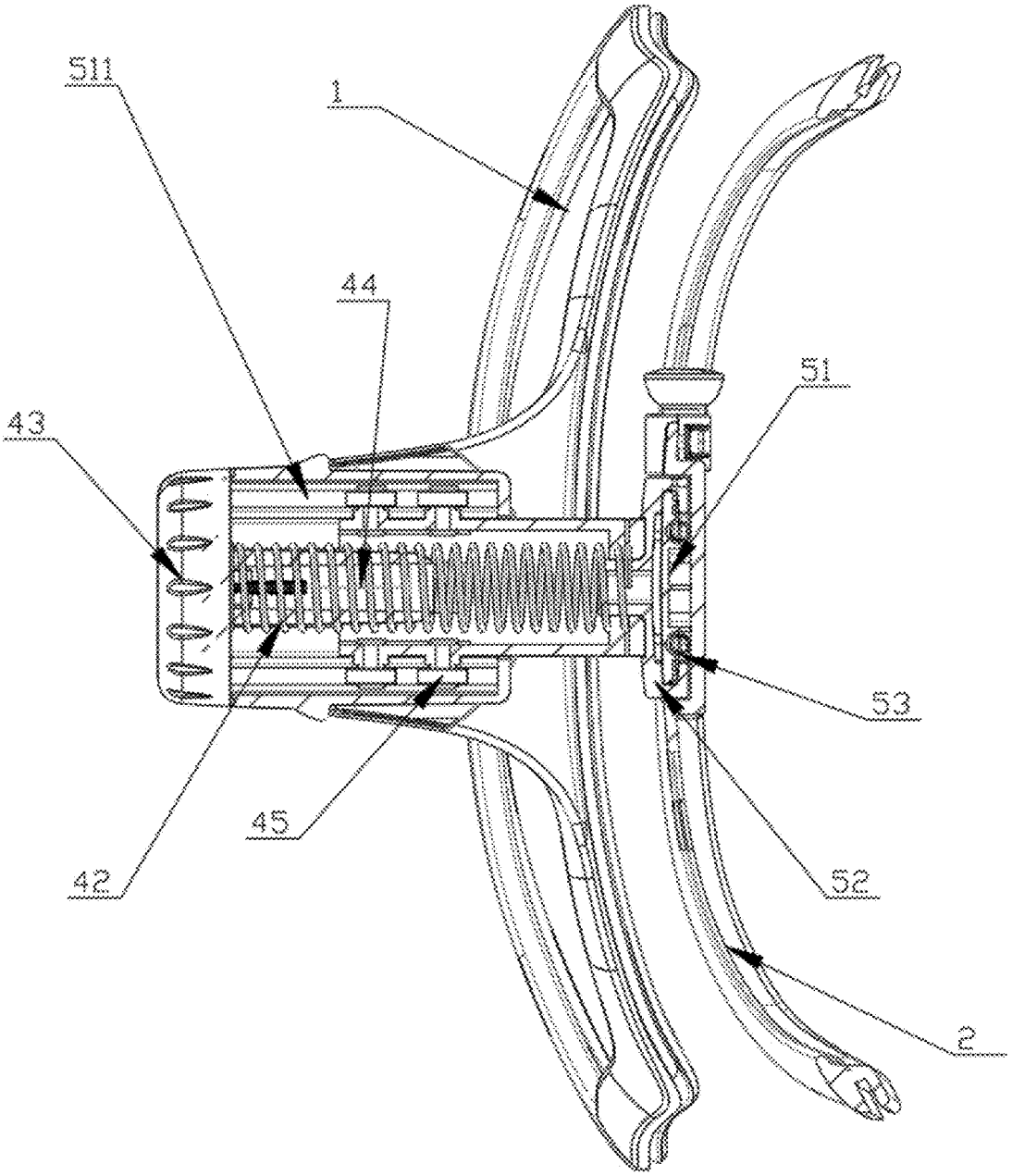
FIG. 10 is a sectional view of the invention.
Figure 11:
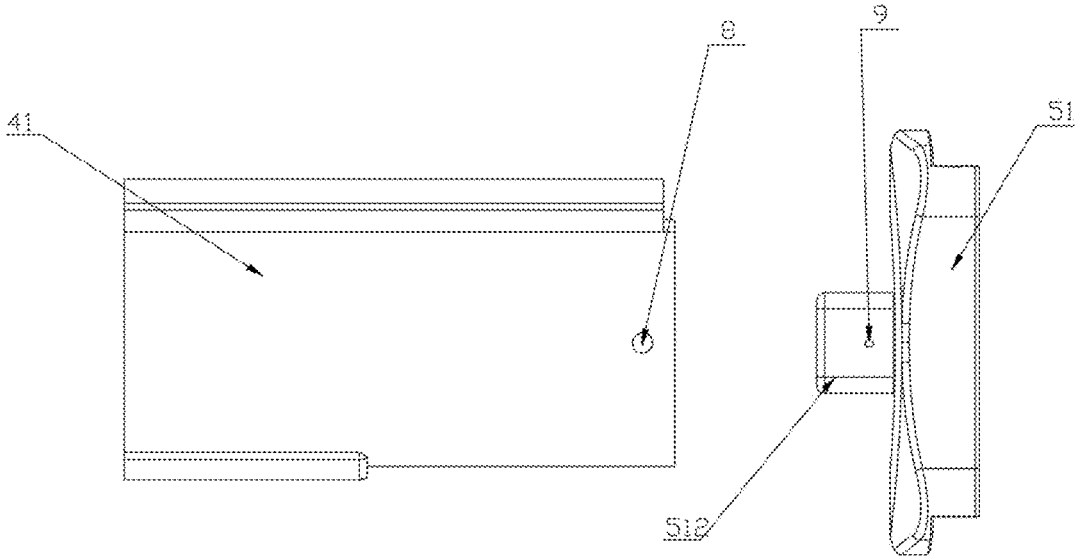
FIG. 11 is a schematic diagram of the sliding tube and the sliding support according to the invention.
Figure 12:
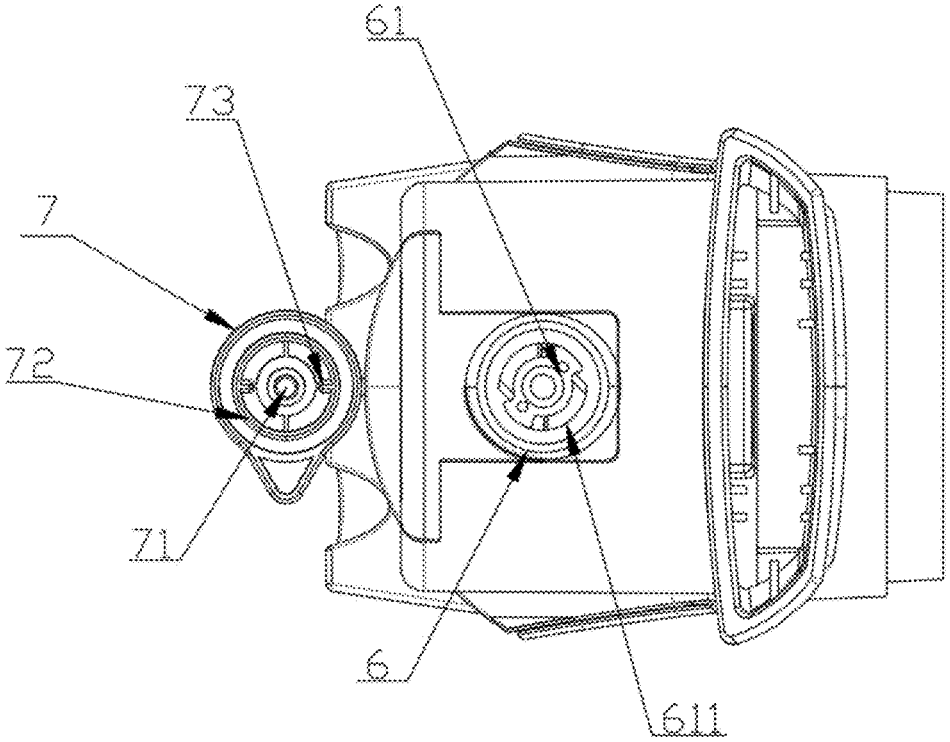
FIG. 12 is a schematic diagram of a limiting knob and a first connecting tube according to the invention.
Figure 13:
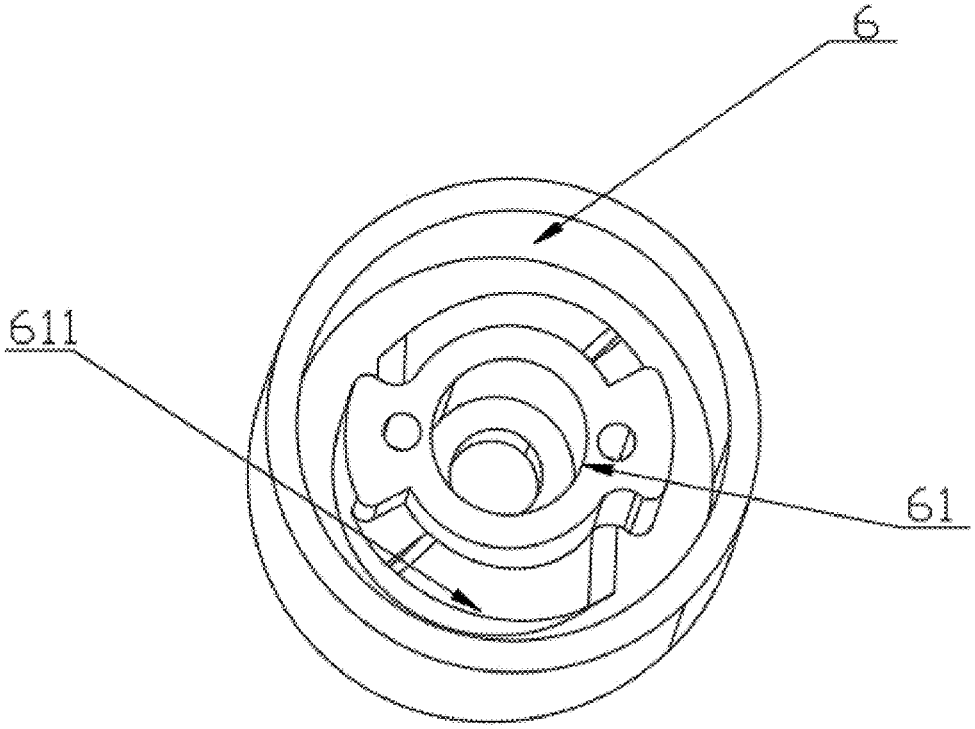
FIG. 13 is a schematic diagram of the first connecting tube according to the invention.
Figure 14:
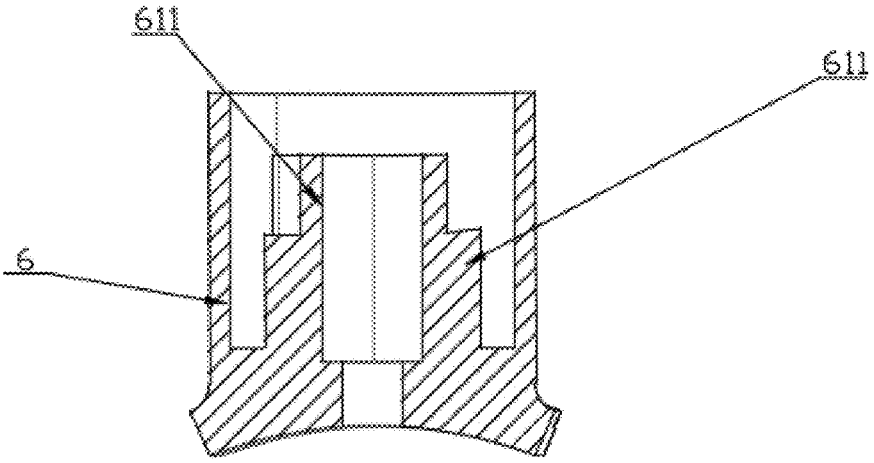
FIG. 14 is a sectional view of the first connecting tube according to the invention.

Referring to FIGS. 1-14, the invention provides a chairback structure capable of providing dynamic support for users in different sitting postures, comprising:

a first chairback 1;

a chairback support 3, the chairback support 3 having an end fixedly connected to the first chairback 1 and an end movably connected to a seat;

a horizontal movement mechanism 4, the horizontal movement mechanism 4 has an end sleeved with the chairback support 3 and an end provided with an elastic lifting mechanism 5, the elastic lifting mechanism 5 having an end fixedly connected to the horizontal movement mechanism 4 and an end provided with a second chairback 2, and the second chairback 2 being movably connected to the elastic lifting mechanism 5;

the second chairback 2 being able to move forward and backward as well as upward and downward by means of the horizontal movement mechanism 4 and the elastic lifting mechanism 5.

The first chairback 1 is arranged above the second chairback 2, the first chairback 1 and the second chairback 2 fit the back and waist of users respectively, and the second chairback 2 is sequentially connected to the elastic lifting mechanism 5 and the horizontal movement mechanism 4. By means of the elastic lifting mechanism 5 and the horizontal movement mechanism 4, the height and horizontal position of the second chairback 2 can be adjusted, the second chairback 2 can move vertically and horizontally to keep its position with respect to the waist of users unchanged, and the users can control the position of the second chairback 2 by means of the frictional resistance between their waist and the second chairback 2 to ensure that their waist can be supported by the second chairback 2 in different postures, thus effectively relieving pains and other symptoms or fatigue caused by a long-term lack of support of the waist during long-term sitting of the users and bringing extremely good comfort to the users.

The operating principle of the invention is as follows:

The second chairback 2 is movably connected to the elastic lifting mechanism 5; when the waist of a user leans against the second chairback 2, a slider 52, in sliding fit with a sliding support, in the elastic lifting mechanism 5 moves with the movement of the user; second springs 53 are arranged in first sliding grooves 511 of the sliding support, bumps 521 on the slider 52 abut against the second springs 53, and when the user leans back or presses against the second chairback 2, the bumps 521 will squeeze the second springs 53, the second springs 53 squeezed by the bumps 521 will generate an elastic force, and under the action of the elastic force, the second chairback 2 can return to the original height after the user leaves the second chairback 2; in the horizontal movement mechanism 4, sliding wheels 45 on a sliding tube 41 work together with guide grooves 33 in a fixing tube 31 to realize horizontal sliding of the second chairback 2, a first spring 42 disposed around a positioning pillar 44 in the sliding tube 41 is fixedly connected to an adjusting knob 43, and when the sliding tube 41 slides, the first spring 42 will be squeezed, and under the action of the first spring 42, the second chairback 2 can return to the initial horizontal position; and under the action of the first spring 42 and the second springs 53, the second chairback 2 can move with the movement of the waist of the user and can also move horizontally and vertically, thus having a high degree of freedom. The first spring 42 is fixedly connected to the adjusting knob 43, such that the tension of the first spring 42 can be adjusted by rotating the adjusting knob 43, to indirectly adjust the resilience force and support force of the second chairback 2; in addition, the elastic lifting mechanism 5 and the horizontal movement mechanism 4 are both provided with locking structures, such as a limiting knob on the horizontal movement mechanism 4 and limiting through-holes 411 in the sliding tube 41; when the user wants to fix the second chairback 2 at a suitable position, the user can insert the limiting knob into the corresponding limiting through-hole 411 to keep the horizontal position of the second chairback 2 unchanged; similarly, a limiting and adjusting rod is arranged on the second chairback 2, limiting grooves 522 allowing the limiting and adjusting rod to be inlaid therein are formed in the slider 52, and the second chairback 2 can be fixed at different heights by inlaying the limiting and adjusting rod in the limiting grooves 522 in different positions.

In another embodiment, the chairback structure capable of providing dynamic support for users in different sitting postures comprises all the technical features in the above embodiment, the horizontal movement mechanism 4 comprises a sliding tube 41 with an open end, a first spring 42 and an adjusting knob 43, a fixing tube 31 with two open ends is arranged on the chairback support 3, and the chairback support 3 is disposed around the fixing tube 31; the adjusting knob 43 is movably connected to one end of the fixing tube 31; a positioning pillar 44 is arranged on an end surface of the adjusting knob 43, and the positioning pillar 44 is sequentially sleeved with the first spring 42, the sliding tube 41 and the fixing tube 31; and the sliding tube 41 is in sliding fit with the fixing tube 31, an end, close to the elastic lifting mechanism 5, of the sliding tube 41 is fixedly connected to the elastic lifting mechanism 5, one end of the first spring 42 is fixed to the end surface of the adjusting knob 43, and the other end of the first spring 42 abuts against the elastic lifting mechanism 5. By means of the sliding fit between the sliding tube 41 and the fixing tube 31, the second chairback 2 can move horizontally; the first spring 42 in the sliding tube 41 is connected to the elastic lifting mechanism 5 and the adjusting knob 42, such that when the second chairback 2 moves horizontally, the first spring 42 will be squeezed or released with the movement of the second chairback 2, the first spring 42 can also be compressed or released by rotating the adjusting knob 43 to control the tension of the first spring 42 so as to control the elastic support force applied to the second chairback 2 by the horizontal movement mechanism 4.

Further, the chairback structure capable of providing dynamic support for users in different sitting postures further comprises the elastic lifting mechanism 5 used for controlling the height of the second chairback 2, the elastic lifting mechanism 5 comprises a sliding support 51, a slider 52 and second springs 53, a first recess 21 is formed in the second chairback 2, and the sliding support 51 is fixedly arranged in the first recess 21; the slider 52 is disposed around the sliding support 51, two first sliding grooves 511 are formed in one side, close to the second chairback 2, of the sliding support 51, the second springs 53 are arranged in the first sliding grooves 511, the slider 52 is provided with at least two bumps 521, the at least two bumps 521 are oppositely arranged in the first sliding grooves 511, a connecting block 512 is arranged on the other side of the sliding support 51 and provided with a threaded connecting hole 9, a mounting hole is formed in an end, away from the adjusting knob 43, of the sliding tube 41, the connecting block 512 is disposed in the mounting hole, a connecting hole 9 is formed in a wall of the sliding tube 41, and an external bolt penetrates through the connecting hole 8 and the threaded connecting hole 9 to realize stationary fit between the sliding support 51 and the sliding tube 41. When the slider 52 drives the second chairback 2 to slide downward, the bumps 521 squeeze the second springs 53 to generate an elastic force, and after the second springs 53 are released, the second chairback 2 returns to the original position. By means of the elastic lifting mechanism 5 and the horizontal movement mechanism 4, users can freely adjust the position of the second chairback 2 in the horizontal direction and the vertical direction; the springs can provide an elastic support force for the second chairback 2, such that when the second chairback 2 moves with respect to the waist of the users, the second chairback 2 can closely follow the waist of the users, and the users can drive the second chairback 2 to move merely by means of the frictional resistance generated when the waist moves and do not need to intentionally adjust the second chairback 2 in other ways.

In another embodiment, the chairback structure capable of providing dynamic support for users in different sitting postures comprises all the technical features in the above embodiment, at least one limiting groove 522 is formed in one side of the slider 52, a first slot is formed in a wall, opposite to the limiting groove 522, of the first recess 21, a limiting and adjusting rod and a fixing part are arranged on the second chairback 2, the fixing part is fixedly arranged in the first slot, the limiting and adjusting rod is disposed in a cavity of the fixing part and movably connected to the fixing part, and one end of the limiting and adjusting rod is inlaid in the limiting hole 522 by means of the first slot. By means of the limiting and adjusting rod, the position of the elastic lifting mechanism 5 can be locked to fix the second chairback 2 to a height desired by users. Similarly, on the horizontal movement mechanism 4, a limiting pillar on the limiting knob work together with first through-holes 311 in the sliding tube 41 to fix the horizontal position of the second chairback 2, and users can freely adjust the second chairback 2 to the most comfortable position and maintain it at this position by means of the limiting and adjusting rod and the limiting knob.

In another embodiment, the chairback structure capable of providing dynamic support for users in different sitting postures comprises all the technical features in the above embodiment, at least one sliding wheel 45 is symmetrically arranged on an outer wall of the sliding tube 41, and the sliding wheel 45 is fixedly connected to the sliding tube 41; at least one guide pillar 32 is arranged on an inner wall of the fixing tube 31 and integrally formed with the fixing tube 31, guide grooves 33 are formed in the guide pillars 32, sides, provided with the guide grooves 33, of two guide pillars 32 face each other, and the at least one sliding wheel 45 is inlaid between the two guide grooves 33. Through the cooperation between the sliding wheel 45 and the guide grooves 33, the sliding tube 41 can slide more smoothly. Wherein, the sliding wheel 45 may be configured as a rotatable wheel, and two rotatable wheels are arranged on each of two sides of the sliding tube 41. Different from the prior art where sliding is implemented by means of surface friction between sliding blocks and rails, the movement structure in the application is designed to be spherical to change surface-surface friction into point-surface friction, the friction between the sliding wheel 45 and the guide grooves 33 is reduced, and the problem of unsmooth sliding of the second chairback 2 caused by large friction between surfaces is solved. In this way, the second chairback 2 can stretch and retract more easily by means of the sliding of wheels, thus improving usage experience of users.

In another embodiment, the chairback structure capable of providing dynamic support for users in different sitting postures comprises all the technical features in the above embodiment, at least one limiting through-hole 411 is formed in a wall of the sliding tube 41, a first connecting tube 6 with an open end is formed on an outer wall of a fixing tube, the open end of the first connecting tube 6 is sleeved with a limiting knob 7, the limiting knob 7 is movably connected to the first connecting tube 6, a first through-hole is formed in a wall, connected to the sliding tube 41, of the first connecting tube 6, the limiting knob 7 is fixedly connected to one end of a limiting pillar 71, and the other end of the limiting pillar 71 is inlaid in the limiting through-hole 411 by means of the first through-hole; a first connecting pillar 61 with two open ends is arranged in the first connecting tube 6, two opposite external threads 611 are symmetrically arranged on an outer wall of the first connecting pillar 61, a second connecting tube 72 with an open end is arranged on an end surface, connected to the limiting pillar 71, of the limiting knob 7, at least two second connecting pillars 73 are symmetrically arranged on an inner wall of the second connecting tube 72, and the two second connecting pillars 73 clamp the first connecting pillar 61 and fit the external threads 611. When the limiting knob 7 is rotted, the second connecting pillars 73 rotate along the external threads 611 to allow the limiting pillar 71 to stretch into or retract from of the limiting through-hole 411, such that users can freely change the horizontal position of the sliding tube; and in conjunction with the limiting and adjusting rod, used for fixing the elastic lifting mechanism, on the second chairback, users can freely adjust and fix the horizontal and vertical positions of the second chairback.

The invention has the following advantages:

(1) By means of the horizontal movement mechanism and the elastic lifting mechanism, the second chairback can dynamically support the waist of users in any sitting postures and can adaptively follow the waist of the users, and the chairback structure has an extremely high degree of freedom, improves the comfortable usage experience of the users, and relieves fatigue and pains of the waist of the users caused by long-term sitting.

Several specific embodiments of the invention are disclosed above, and the invention is not limited to the above embodiments. All variations that can be obtained by any skilled in the art should fall within the protection scope of the invention.

What is claimed is:

1. A chairback structure capable of providing dynamic support for users in different sitting postures, comprising:

a first chairback;

a chairback support, the chairback support having an end fixedly connected to the first chairback and an end movably connected to a seat; and a horizontal movement mechanism, the horizontal movement mechanism having an end sleeved with the chairback support and an end provided with an elastic lifting mechanism, the elastic lifting mechanism having an end fixedly connected to the horizontal movement mechanism and an end provided with a second chairback, and the second chairback being movably connected to the elastic lifting mechanism;

wherein in operation, the second chairback moves forward and backward as well as upward and downward by means of the horizontal movement mechanism and the elastic lifting mechanism;

wherein the horizontal movement mechanism comprises a sliding tube with an open end, a first spring and an adjusting knob, a fixing tube with two open ends is arranged on the chairback support, and the chairback support is disposed around the fixing tube; the adjusting knob is movably connected to an end of the fixing tube; a positioning pillar is arranged on an end surface of the adjusting knob and sequentially sleeved with the first spring, the sliding tube and the fixing tube; the sliding tube is in sliding fit with the fixing tube, and an end, close to the elastic lifting mechanism, of the sliding tube is fixedly connected to the elastic lifting mechanism; and the first spring has an end fixed to the end surface of the adjusting knob and an end abutting against an inner end surface of the sliding tube;

wherein the elastic lifting mechanism comprises a sliding support, a slider and at least one second spring, a recess is formed in the second chairback, and the sliding support is fixedly arranged in the first recess; the slider is disposed around the sliding support, at least two first sliding grooves are formed in one side, close to the second chairback, of the sliding support, the second springs are arranged in the first sliding grooves, the slider is provided with at least two bumps, and each of the bumps correspondingly stretches into at least one of the first sliding grooves and correspondingly abuts against one said second springs; and a connecting block is arranged on the other side of the sliding support, a threaded connecting hole is formed in the connecting block, a mounting hole is formed in an end, away from the adjusting knob, of the sliding tube, the connecting block is disposed in the mounting hole, a connecting hole is formed in a wall of the sliding tube, and an external bolt penetrates through the connecting hole and the threaded connecting hole to realize stationary fit between the sliding support and the sliding tube.

2. The chairback structure capable of providing dynamic support for users in different sitting postures according to claim 1, wherein at least one limiting groove is formed in a side of the slider, a first slot is formed in a wall, opposite to the limiting groove, of the first recess, a limiting and adjusting rod and a fixing part are arranged on the second chairback, the fixing part is fixedly arranged in the first slot, the limiting and adjusting rod is disposed in a cavity of the fixing part and movably connected to the fixing part, and an end of the limiting and adjusting rod is inlaid in the limiting groove by means of the first slot.

3. A chairback structure capable of providing dynamic support for users in different sitting postures, comprising:

a first chairback;

a chairback support, the chairback support having an end fixedly connected to the first chairback and an end movably connected to a seat; and a horizontal movement mechanism, the horizontal movement mechanism having an end sleeved with the chairback support and an end provided with an elastic lifting mechanism, the elastic lifting mechanism having an end fixedly connected to the horizontal movement mechanism and an end provided with a second chairback, and the second chairback being movably connected to the elastic lifting mechanism;

wherein in operation, the second chairback moves forward and backward as well as upward and downward by means of the horizontal movement mechanism and the elastic lifting mechanism;

wherein the horizontal movement mechanism comprises a sliding tube with an open end, a first spring and an adjusting knob, a fixing tube with two open ends is arranged on the chairback support, and the chairback support is disposed around the fixing tube; the adjusting knob is movably connected to an end of the fixing tube; a positioning pillar is arranged on an end surface of the adjusting knob and sequentially sleeved with the first spring, the sliding tube and the fixing tube; the sliding tube is in sliding fit with the fixing tube, and an end, close to the elastic lifting mechanism, of the sliding tube is fixedly connected to the elastic lifting mechanism; and the first spring has an end fixed to the end surface of the adjusting knob and an end abutting against an inner end surface of the sliding tube;

wherein at least one sliding wheel is symmetrically arranged on an outer wall of the sliding tube and fixedly connected to the sliding tube; at least one guide pillar is arranged on an inner wall of the fixing tube and integrally formed with the fixing tube, guide grooves are formed in the guide pillars, sides, provided with the guide grooves, of two said guide pillars face each other, and the at least one sliding wheel is inlaid between the two guide grooves.

4. A chairback structure capable of providing dynamic support for users in different sitting postures, comprising:

a first chairback;

a chairback support, the chairback support having an end fixedly connected to the first chairback and an end movably connected to a seat; and a horizontal movement mechanism, the horizontal movement mechanism having an end sleeved with the chairback support and an end provided with an elastic lifting mechanism, the elastic lifting mechanism having an end fixedly connected to the horizontal movement mechanism and an end provided with a second chairback, and the second chairback being movably connected to the elastic lifting mechanism;

wherein in operation, the second chairback moves forward and backward as well as upward and downward by means of the horizontal movement mechanism and the elastic lifting mechanism;

wherein the horizontal movement mechanism comprises a sliding tube with an open end, a first spring and an adjusting knob, a fixing tube with two open ends is arranged on the chairback support, and the chairback support is disposed around the fixing tube; the adjusting knob is movably connected to an end of the fixing tube; a positioning pillar is arranged on an end surface of the adjusting knob and sequentially sleeved with the first spring, the sliding tube and the fixing tube; the sliding tube is in sliding fit with the fixing tube, and an end, close to the elastic lifting mechanism, of the sliding tube is fixedly connected to the elastic lifting mechanism; and the first spring has an end fixed to the end surface of the adjusting knob and an end abutting against an inner end surface of the sliding tube;

wherein at least one limiting through-hole is formed in a wall of the sliding tube, a first connecting tube with an open end is formed on an outer wall of the fixing tube, the open end of the first connecting tube is sleeved with a limiting knob, the limiting knob is movably connected to the first connecting tube, a first through-hole is formed in a wall, connected to the sliding tube, of the first connecting tube, the limiting knob is fixedly connected to one end of a limiting pillar, and the other end of the limiting pillar is inlaid in the limiting through-hole by means of the first through-hole;

wherein a first connecting pillar with two open ends is arranged in the first connecting tube, two opposite external threads are symmetrically arranged on an outer wall of the first connecting pillar, a second connecting tube with an open end is arranged on an end surface, connected to the limiting pillar, of the limiting knob, at least two second connecting pillars are symmetrically arranged on an inner wall of the second connecting tube, and the two second connecting pillars clamp the first connecting pillar and fit the external threads.

* * * * *